US007798610B2

(12) United States Patent
Oikawa

(10) Patent No.: US 7,798,610 B2
(45) Date of Patent: Sep. 21, 2010

(54) INK JET PRINTING HEAD

(75) Inventor: Satoshi Oikawa, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 677 days.

(21) Appl. No.: 11/762,416

(22) Filed: Jun. 13, 2007

(65) Prior Publication Data

US 2008/0001998 A1 Jan. 3, 2008

(30) Foreign Application Priority Data

Jun. 29, 2006 (JP) ..... 2006-179899

(51) Int. Cl.
*B41J 2/04* (2006.01)

(52) U.S. Cl. ..... 347/54

(58) Field of Classification Search ..... 347/54, 347/56, 61–65, 67, 70, 47, 44, 20
See application file for complete search history.

(56) References Cited

U.S. PATENT DOCUMENTS 6,247,791 B1 * 6/2001 Silverbrook ..... 347/54
6,817,702 B2 11/2004 Delametter et al.
6,820,964 B2 11/2004 Delametter et al.
6,824,249 B2 11/2004 Delametter et al.
7,025,443 B2 * 4/2006 Cabal et al. ..... 347/54
7,669,979 B2 * 3/2010 Silverbrook ..... 347/61

FOREIGN PATENT DOCUMENTS

JP 2004-082733 3/2004
JP 2004-160650 6/2004

* cited by examiner

*Primary Examiner*—K. Feggins
(74) *Attorney, Agent, or Firm*—Fitzpatrick, Cella, Harper & Scinto

(57) ABSTRACT

A groove for a separate liquid chamber opening is provided in the vicinity of a location in a first separate liquid chamber to which a cantilever element is fixed and the groove extends overall in a vertical direction of the separate liquid chamber. The flow resistance of flow across the cantilever element from the upper side to the lower side of the separate liquid chamber through the opening is sufficiently small compared to the flow resistance of flow through the other small gap. Therefore, the ink flow from a common liquid chamber to the lower side of the cantilever element in each separate liquid chamber, which is caused with every ink ejection, passes through substantially two separate liquid chamber openings. As a result, the stagnation of ink flow in the first separate liquid chamber is reduced and the bubbles are smoothly flushed out.

7 Claims, 7 Drawing Sheets

INK JET PRINTING HEAD

BACKGROUND OF THE INVENTION

1. Field of the Invention

The present invention relates to an ink jet printing head, and particularly to a printing head that ejects ink with a thermo-mechanical actuator.

2. Description of the Related Art

Conventionally, as an ejection method of printing heads used in ink jet printers and the like, for example, a thermal jet type which ejects droplets of printing liquid through a bubble caused in the printing liquid by means of an electric resistance heater and a piezoelectric type which mechanically pressurizes the printing liquid, are in practical use. On the other hand, a thermo-mechanical actuator type, with its two advantages of being of low cost due to the use semiconductor manufacturing as the thermal jet type and the high degree of freedom for available printing liquid as used in the piezoelectric type, is in use as a known method for ejecting ink (refer to Japanese Patent Laid-Open No. 2004-160650).

A thermo-mechanical actuator has a cantilever element formed of a plurality of layers having different thermal expansion coefficients. The current flowing into each layer of the cantilever elements is controlled so that the lever element bends due to the different thermal expansions for generating the ink ejection pressure.

For the cantilever elements, various types have been proposed, for example, a cantilever element with a tapered shape is known and intended to improve ejection energy efficiency (refer to Japanese Patent Laid-Open No. 2004-082733).

FIGS. 6A to 6D are views showing ejection part structures and an ejection operation of printing heads using conventional thermo-mechanical actuators. FIG. 6A is a side cross-sectional view of a common liquid chamber H160, which communicates with each of the plurality of ejection portions arranged in a printing head to supply ink to them, and one ejection portion H111. FIG. 6B is a view of the ejection portion viewed from an ejection opening side with the members forming the ejection opening being removed.

As shown in these figures, the ejection portion H111 has two chambers, a first separate liquid chamber H220 and second separate liquid chamber H221, which communicate with each other, and each of which is connected to the common liquid chamber H160. A cantilever element H230 is provided in a cantilevered state in which one end of the element is fixed to the inner wall surface of the first separate liquid chamber H220 and at the same time the element extends to the inside of the first separate liquid chamber H220 and the second separate liquid chamber H221. As shown in FIG. 6B, when viewed from the common liquid chamber, the first separate liquid chamber H220 has a rectangular cross-section and the second separate liquid chamber H221 a circular cross-section. The second separate liquid chamber H221 is provided with an ejection opening H240 (shown by a dashed line in FIG. 6B) on the wall surface that forms the chamber H221 and is opposite to the common liquid chamber H160 relative to the cantilever element H230.

The cantilever element H230 has a three layered structure of a first deflector layer H231 and a second deflector layer H232 with relatively large thermal expansion coefficients, and a barrier layer H233, which is interposed between the first deflector layer H231 and the second deflector layer H232 and is made of a material with relatively low thermal conduction rate and smaller thermal expansion coefficient.

As shown in FIG. 6B, the planar shape of the cantilever element H230 has a region of trapezoid which is located inside the first separate liquid chamber H220 and expands toward the fixed side at the inner wall surface of the first separate liquid chamber H220. Also a region located inside the second separate liquid chamber H221 has circular shape. The first deflector layer H231 and the second deflector layer H232 are electrically connected to a wiring portion H250 at the outside of the first separate liquid chamber H220. Thereby, when ejecting ink, the electric pulses required for ejecting ink are applied to the first deflector layer H231 and the second deflector layer H232.

As above mentioned, the cantilever element H230 has a triple layered structure comprising the first deflector layer H231 and the second deflector layer H232 with large thermal expansion coefficients, and the third deflector layer H233 interposed between them, which is made of a material with low thermal conduction rate and small thermal expansion. Therefore, when electrical pulses are applied to the first deflector layer H231 or the second deflector layer H232, the first deflector layer H231 or the second deflector layer H232 is heated and expands according to the heat. In this case, the first deflector layer H231 or the second layer H232 bends toward the barrier layer H233 because the first deflector layer H231 or the second layer H232 is closely contacted to the barrier layer H233, which does not expand very much by the heat. This bending motion pressurizes the ink inside the second separate liquid chamber H221 and thus ejects the ink.

More specifically, in a usual state (non-ejecting state), the cantilever element H230 remains horizontal as shown in FIG. 6A.

By applying predetermined electrical pulses to the second deflector layer H232 in the usual state, the second deflector layer H232 is heated and then expands by that heat. And at this time, as the barrier layer H233 does not expand very much, it functions in restricting the expansion of the second deflector layer. As a result, the cantilever element H230 bends in the direction away from an ejection opening H240 (state in FIG. 6C). Through this action, the ink around the ejection opening H240 moves toward the upper part in FIG. 6C and forms a meniscus around the ejection opening H240. This enables the preparation of a good ink drop formation for the next ejecting action.

Thereafter, the second deflector layer H232 is gradually cooled down. At this time, by applying predetermined electrical pulses to the first deflector layer H231, the cantilever element bends similarly to the above but toward the ejection opening H240, which direction is opposite to the direction in the above described action. And through this action, the ink in the second separate liquid chamber H221 is pressurized and ejected as an ink droplet from the ejection opening H240.

Moreover, after that, as the first deflector layer H231 is cooled down, the cantilever element H230 returns to its regular horizontal state (state in FIG. 6A). By repeating all the above actions, the continuous ejection can be performed.

Moreover, reference signs H261, H262, H263 and H264 designate connection portions of respective wirings H251, H252, H253 and H254 for applying the electrical pulses to the first and second deflector layers. For example, a set of the wiring H251 and the connector H261 and a set of the wiring H252 and the connector H262 connect to the first deflector layer. Also, a set of the wiring H253 and the connector H263, and a set of the wiring H254 and the connector H264 connect to the second deflector layer. This connection arrangement allows the desired electrical pulses to be applied to respective deflector layers.

In the ejection action of the thermo-mechanical actuator described above, the amount of ink in the second separate liquid chamber H221 is decreased. This reduced amount of ink is then refilled from the first separate liquid chamber H220 rather than directly from the common liquid chamber H160 which is located above the second separate liquid chamber. The reason comes from that there is the large flow resistance when ink flows across the cantilever element vertically in the second separate liquid chamber H221, because the cross sectional shape of the second separate liquid chamber H221 and the planar shape of the cantilever element H230 are identical and the gap between them is very small.

When thus refilling the ink from the first separate liquid chamber H220, the ink is refilled from where it is most easily to flow in, that is, from the nearest place to the second separate liquid chamber H221 of the structural positions of the first separate liquid chamber H220. The flow of ink, as the arrows A3 and A4 shown in FIG. 6B, goes across the cantilever element H230 from the upper part of the first separate liquid chamber H220 and goes into an under part of the second separate liquid chamber.

However, in the above conventional example, since in the separate first and second liquid chambers the flow of ink caused during every ejection is shown as arrows A3 and A4 in FIG. 6B, the ink in a part of the first separate liquid chamber H220 which part is far away from the second separate liquid chamber H221 does not flow so much and stagnates. Also, this part is located far from where the bending action of the cantilever element directly causes the ink to flow. This also causes the ink in this part to stagnate easily. Therefore, in this part, bubbles generated by ejection operation, etc., easily accumulate. If the accumulated bubbles exceed a given amount, the bubbles then reach the second separate liquid chamber H221 and cause the ejection failure due to the bubbles being taken into the ejection opening H240.

Usually, residual bubbles in the liquid chamber are removed through the recovery action caused by the suction of ink through the ejection opening. However, with liquid chamber structures in which bubbles accumulate and likely to stagnate, removal of the bubbles is difficult even with the recovery action and then the ejection failure sometimes may occur.

SUMMARY OF THE INVENTION

The present invention can provide an ink jet printing head is capable of dissolving any ink stagnation and residual bubbles in the separate liquid chamber to realize continuous good ejections.

In a first aspect of the present invention, there is provided a printing head for ejecting ink comprising: a cantilever element having a free end and a fixed end, said element making a bending action to generate pressure for ejecting the ink; and a liquid chamber in which said cantilever element is provided so that said cantilever element makes the bending action and which is divided into an upper chamber and a lower chamber having an ejection opening by a plane including a plane of said cantilever element, the plane of said cantilever element extending in directions perpendicular to a direction of ink ejected by the bending action, wherein a communicating opening for communicating the upper chamber with the lower chamber is provided in a neighborhood of the fixed end of said cantilever element, and in a part other than the communicating opening, the upper chamber communicating with the lower chamber through a gap the flow resistance of which is greater than that of the communicating opening.

In a second aspect of the present invention, there is provided a printing head for ejecting ink comprising: a cantilever element having a free end and a fixed end, said element making a bending action to generate pressure for ejecting the ink; a liquid chamber in which said cantilever element is provided so that said cantilever element makes the bending action and which is divided into a first chamber and a second chamber having an ejection opening by a plane including a plane of said cantilever element, the plane of said cantilever element extending in directions perpendicular to a direction of ink ejected by the bending action; and a communicating portion for communicating the first chamber with the second chamber, wherein a communicating opening for communicating the upper chamber with the lower chamber is provided in a neighborhood of the fixed end of said cantilever element, and the flow resistance of the communicating opening is the smallest in the communication portion.

With the above structure, the flow resistance of the ink flowing across the cantilever element from the upper part of a liquid chamber to the lower side of the liquid chamber through the communication port is smaller than the flow resistance of the ink flowing through the other small gap. Thereby, the ink flow from the upper part of the liquid chamber to the bottom of the same becomes substantially the flow via the communication port. As a result, since the ink flow occurs even in the region where it is likely to stagnate in the conventional structure, the stagnation in the liquid chamber is reduced and then bubbles are difficult to remain in the region. That is, the ink in the liquid chamber is in whole easy to move to the ejection opening side by ink flows caused by the refilling of the ink for each ejection and the recovery operation. Accordingly, even if bubbles are generated in the separate liquid chamber, the bubbles can be smoothly discharged without remaining or accumulating of the bubbles that influence the ejection operation.

Further features of the present invention will become apparent from the following description of exemplary embodiments with reference to the attached drawings.

DESCRIPTION OF THE EMBODIMENTS

The embodiment of the present invention will be described in detail below while referring to drawings.

Embodiment 1

Figure 1:
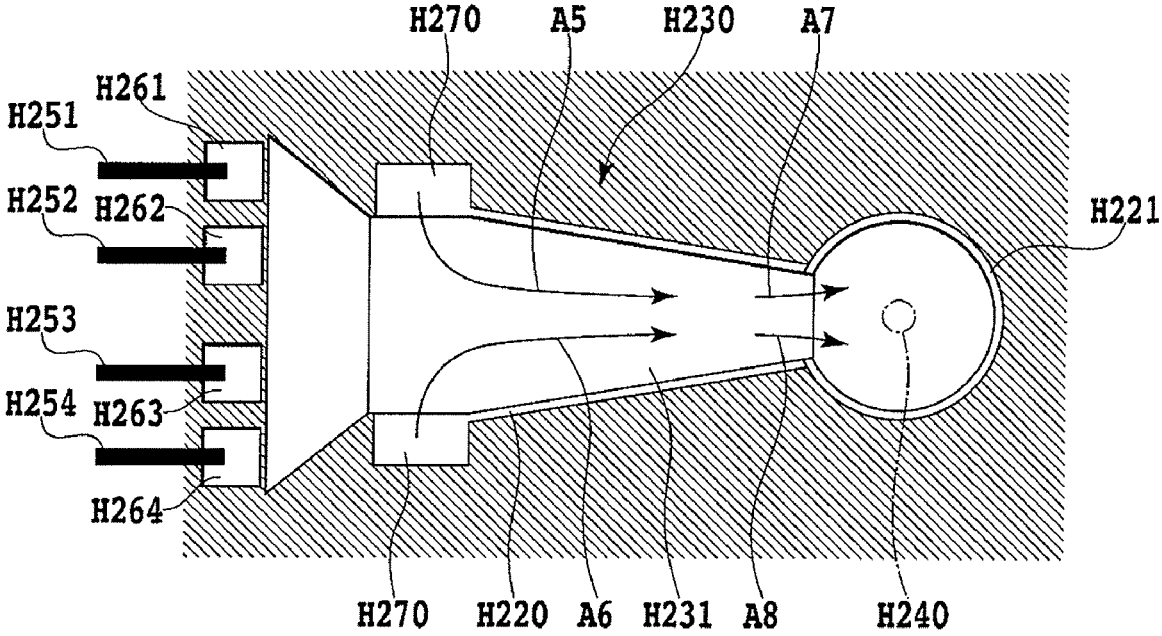
FIG. 1 is a view showing an ejection portion structure using a thermo-mechanical actuator according to a first embodiment of the present invention.
Figure 6A:
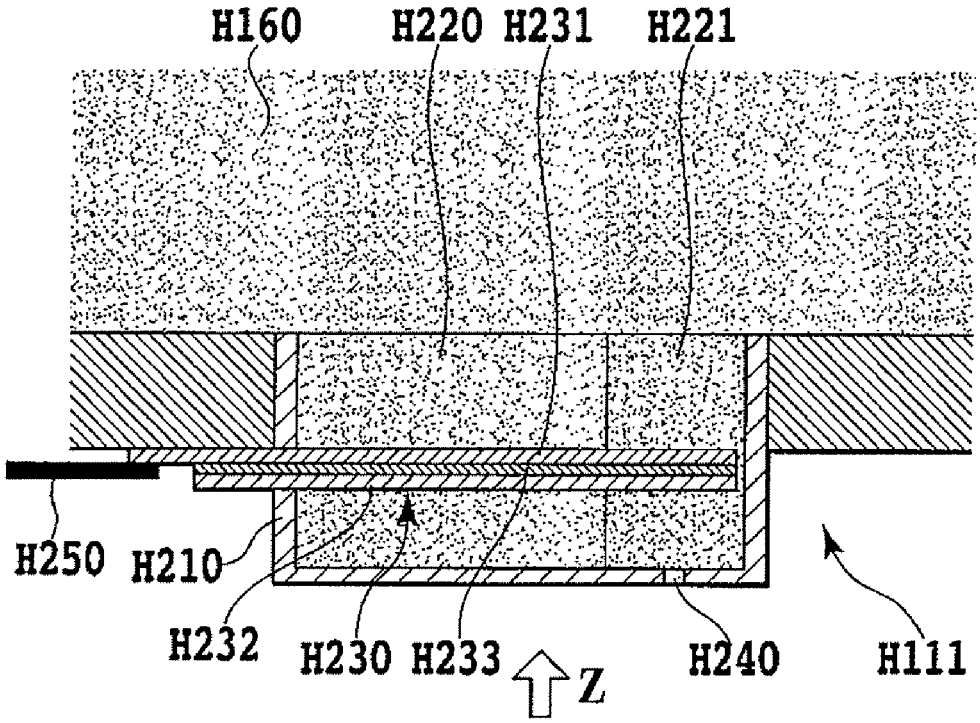
FIGS. 6A to 6D are views showing ejection portion structures of printing heads using conventional thermo-mechanical actuators.
Figure 6B:
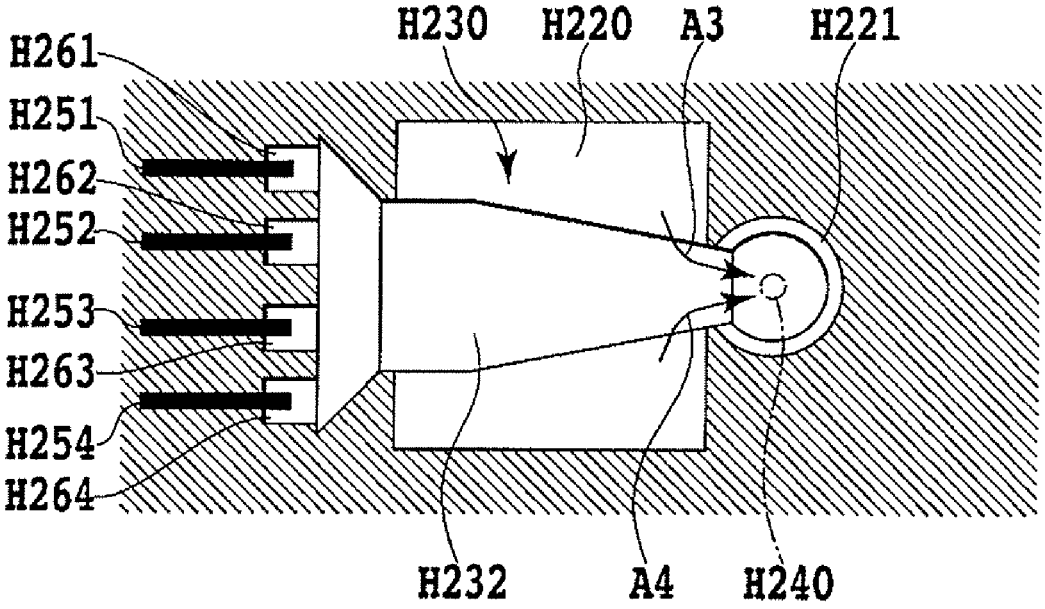
Figure 6C:
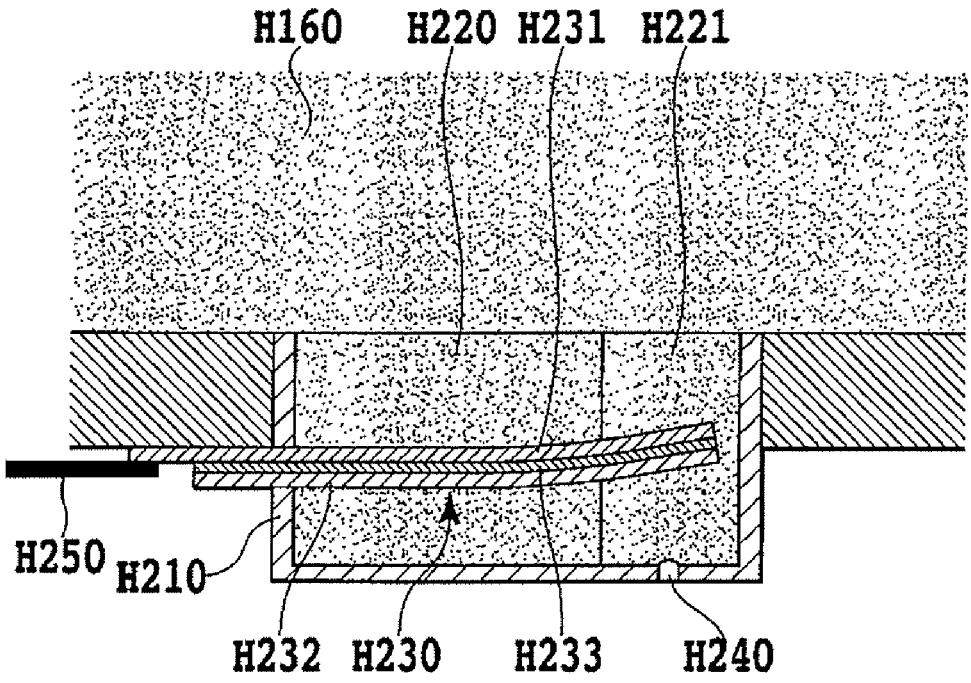
Figure 6D:
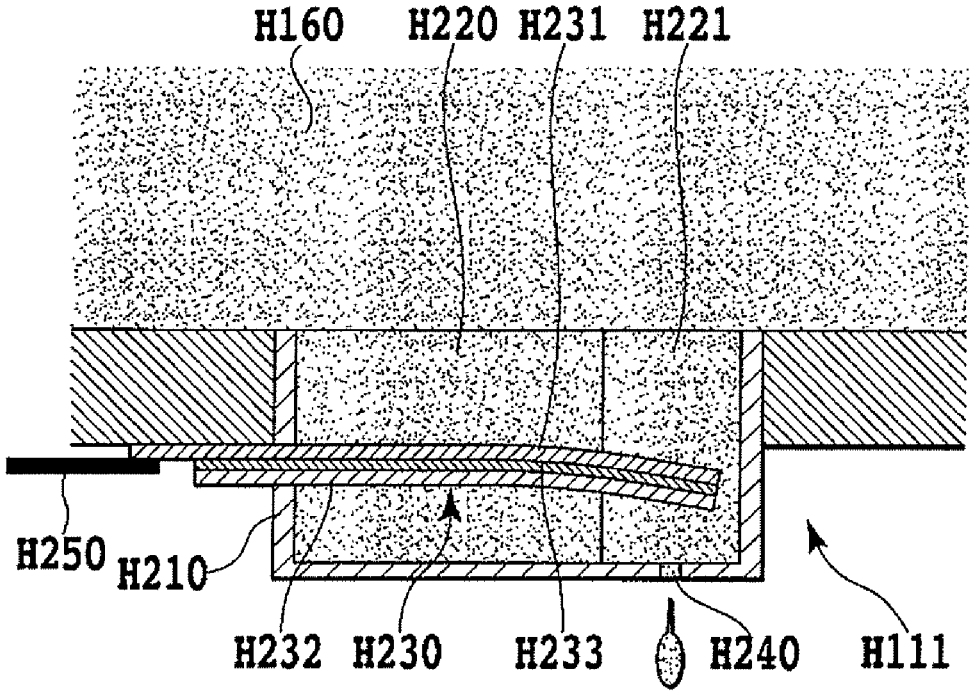

FIG. 1 is a view showing an ejection portion structure using a thermo-mechanical actuator according to a first embodiment of the present invention and illustrates the ejection portion viewed from the ejection opening side. In addition, this figure shows the ejection portion structure with members forming the ejection opening and a liquid chamber being removed. The ejection portion structure according to the present embodiment is identical to the structure such as the cantilever element shown in FIG. 6A, except for what follows as described below.

A cantilever element H230 according to the embodiment of the present invention as shown in FIG. 1 is constructed in trapezoid and circular shapes in cross section. The cross sectional shapes of the two separate liquid chambers of the present embodiment are substantially similar to the outer contour of the cantilever element H230 with a small gap between the element and chambers.

However, at the neighborhood of a part of a first separate liquid chamber H220 to which part the cantilever element H230 is fixed, the chamber has a cross section shape in which the gap between the chamber and the element H230 is larger than that of other part. More specifically, at the vicinity of the fixed position of the first separate liquid chamber H220 to which the cantilever element is fixed, a groove for a separate liquid chamber opening H270 is formed to extend along a vertical direction (ink ejection direction) across the separate liquid chamber. The flow resistance of a flow across the cantilever element H230 from the upper part of the separate liquid chamber to the lower side of the same through the separate liquid chamber opening H270 is adequately smaller than that of flow through the small gap.

Therefore, ink flows to the lower side of the cantilever element H230 in each separate liquid chamber from a common liquid chamber (not shown), which are caused every ejection of ink, pass through substantially two separate liquid chamber openings. That is, the flows are shown with arrows A5, A6, A7 and A8 in FIG. 1. As a result, since the ink is caused to flow in the region where it is likely to stagnate, the stagnation in the first separate liquid chamber is reduced and the bubbles prevented from grouping there. In other words, the ink in the first separate liquid chamber H220 easily moves overall into the second separate liquid chamber H221 by the ink flow due to an ink refilling action for each ejection and the recovery operation. Accordingly, even if bubbles are generated in the separate liquid chamber, the bubbles can be smoothly discharged without remaining or accumulating so as influence the ejection operation.

In addition, the trapezoid shape of the cantilever element H230 corresponding with the first separate liquid chamber contributes to the smooth flow of ink into the second separate liquid chamber H221.

Embodiment 2

Figure 2:
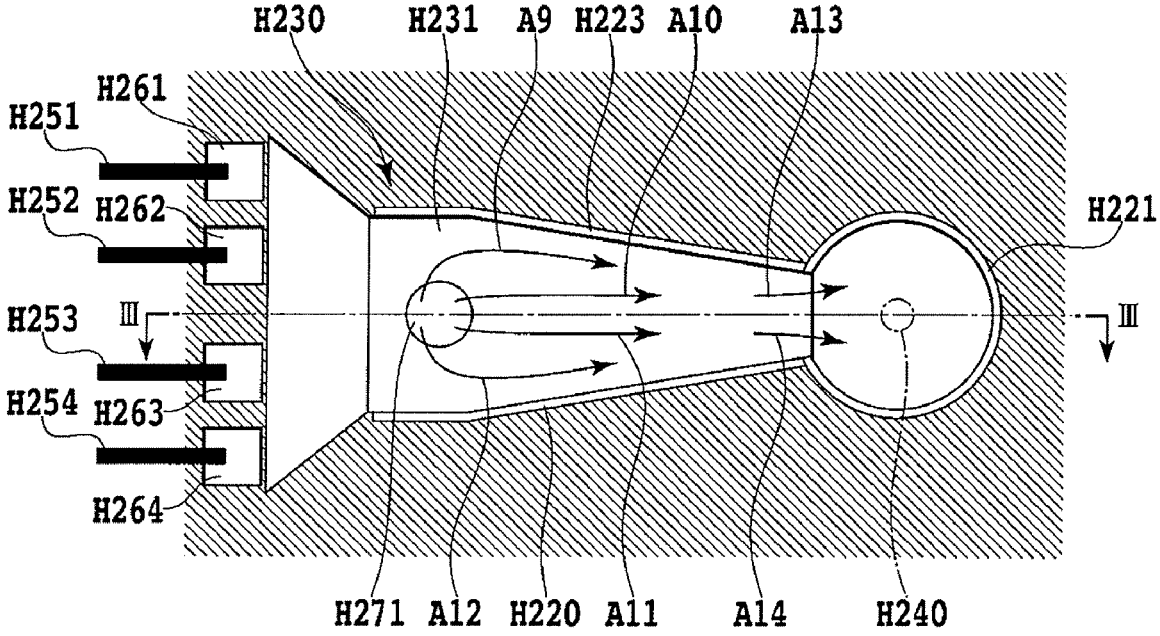
FIG. 2 is a view showing an ejection portion structure using a thermo-mechanical actuator according to a second embodiment of the present invention.

FIG. 2 shows an ejection portion structure according to a second embodiment of the present invention and is similar to FIG. 1. How the ejection portion structure differs from that of the first embodiment shown in FIG. 1 will be mainly described below.

As shown in FIG. 2, the cross sectional shape of the separate liquid chamber according to the present embodiment throughout has a small gap between the chamber and the outer contour of the cantilever element H230. However, a circular opening H271 is provided on a part of the cantilever element H230 which is close to the inner wall of the first separate liquid chamber H220, to which wall the cantilever element H230 is fixed. The relationship of the flow resistance of the circular opening H271 to the small gap between the separate liquid chamber and the cantilever element H230 is that the flow resistance of the ink passing through the small gap is adequately large compared to the flow resistance of the ink passing through the circular opening H271.

By forming the separate liquid chamber and the cantilever element in the above mentioned shapes, ink flows from the common liquid chamber (not shown) to the separate liquid chamber pass substantially through the circular opening H271 as shown with arrows A9, A10, A11, A12, A13 and A14 shown in FIG. 2.

Figure 3:
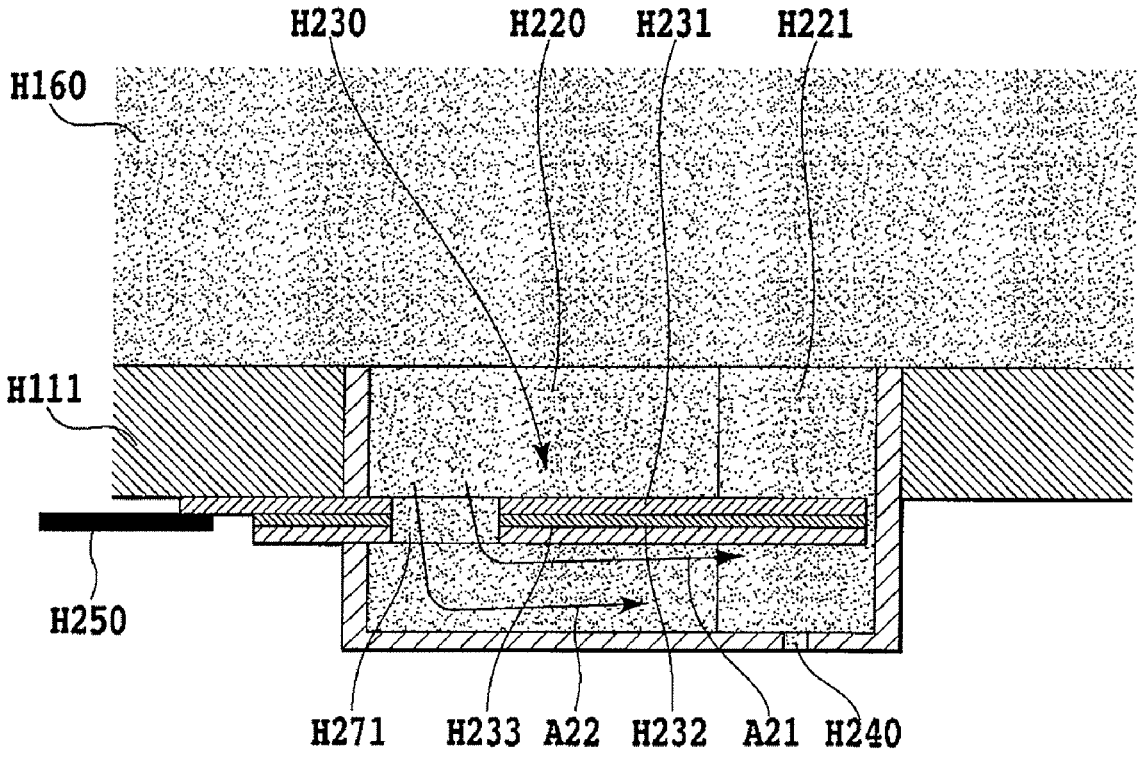
FIG. 3 is a view showing the ink flow in the ejection portion in a III-III cross section of FIG. 2.

FIG. 3 is a view showing the ink flows in cross section of a III-III line given in FIG. 2. As shown in FIG. 3, the ink flows from the common liquid chamber or the upper part of the first and second separate liquid chambers are shown with arrows A21 and A22. More specifically, the ink is made to flow toward the opening H271 not only from the upper part of the opening H271 but also from the entire common liquid chamber or the entire first separate liquid chamber H220 and second separate liquid chamber H221. Thereby, a stagnation portion of ink flow is prevented from being formed in the separate liquid chamber. Moreover, the upper side of the opening H271 is far away from the where the cantilever element bends, and ink flow is caused there. Thereby, the ink easily flows in the whole separate liquid chamber.

As a result, the stagnation of ink flow is reduced in the first separate liquid chamber H220 and the bubbles prevented from remaining there. That is, the ink flows due to refilling every ejection or the recovery operation allow the ink in the first separate liquid chamber H220 easily to move overall into the second separate liquid chamber H221. Therefore even if bubbles are generated in the separate liquid chamber, they are smoothly discharged without remaining there and accumulating so as to influence the ejection of the ink.

Furthermore, the opening provided on the cantilever element H230 serves as an inflow portion of the ink from the common liquid chamber, thereby simplifying the contours of the separate liquid chamber and reducing the production load. Also, as the opening is circular, the bending stress on the cantilever element H230 is dispersed, and the durability of the element improved.

Embodiment 3

Figure 4:
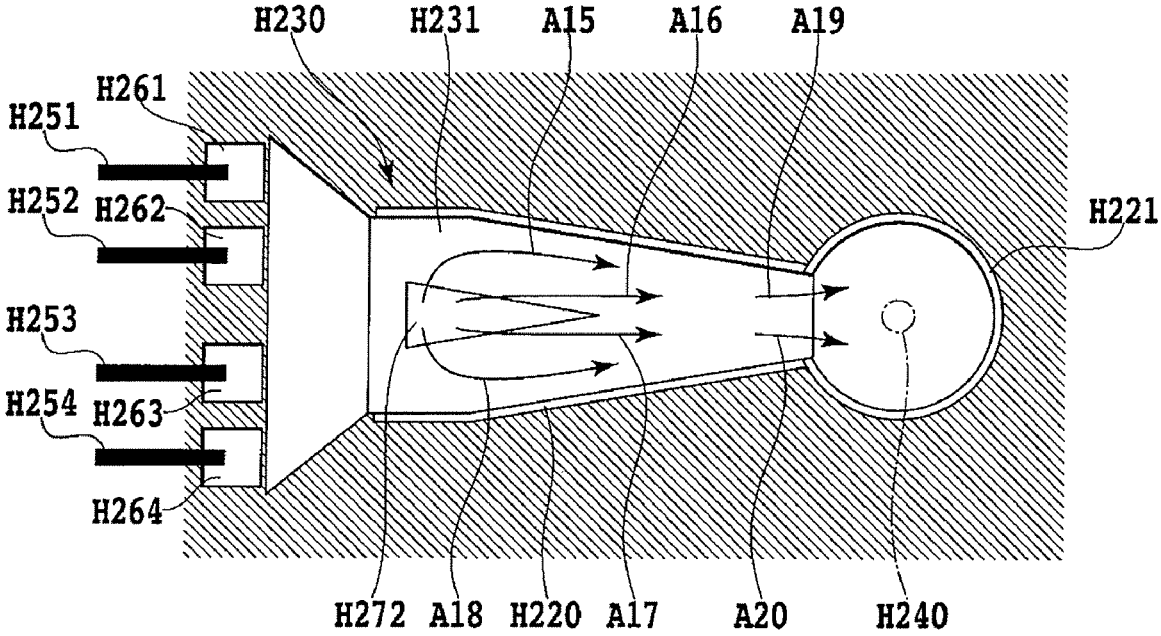
FIG. 4 is a view showing an ejection portion structure using a thermo-mechanical actuator according to a third embodiment of the present invention.

FIG. 4 is a view showing an ejection portion structure according to a third embodiment of the present invention and is similar to FIG. 1. How the ejection portion structure differs from that of the first embodiment will be mainly described below.

As shown in FIG. 4, the cross-sectional shape of the separate liquid chamber according to the present embodiment is such that there is a small gap between the chamber and the outer contour of the cantilever element H230. A triangular opening H272 is provided on a part of the cantilever element H230 which is close to the inner wall of the first separate liquid chamber H220, to which the cantilever element H230 is fixed. The relationship of the flow resistance of the triangular opening H272 to the small gap between the separate liquid chamber and the cantilever element H230 is such that the flow resistance of the ink passing through the small gap is large enough compared to the flow resistance of the ink passing through the triangular opening H272.

The separate liquid chamber and the cantilever element are formed in the above mentioned shapes and thereby the ink flows from the common liquid chamber (not shown) into the separate liquid chamber which are caused by the ink ejection pass substantially through the triangular opening H272. The ink flows in the directions shown with arrows A15, A16, A17, A18, A19 and A20 in FIG. 4. As a result, stagnation in the first separate liquid chamber H220 is reduced and bubbles are prevented from remaining there. That is, the ink flow due to the recovery action or the ink refilling after every ejection of the ink in the first separate liquid chamber easily moves overall into the second separate liquid chamber H221. Therefore, even if bubbles are caused in the separate liquid chamber, the bubbles can be smoothly discharged without remaining there and accumulating so as to influence the ink ejection.

Moreover, the triangular opening provided on the cantilever element H230 serves as an inflow portion for the ink, and thereby the contour of the separate liquid chamber can be simplified and the production load reduced. Also, since the opening is triangular in the cross section, the ink does not easily flow to the apex of the triangle and instead easily flows to the bottom. Moreover, the ink flows in from the root side of the cantilever element H230 to the separate liquid chamber. Thereby, stagnation in the separate liquid chamber can be effectively dissolved.

Embodiment 4

Figure 5:
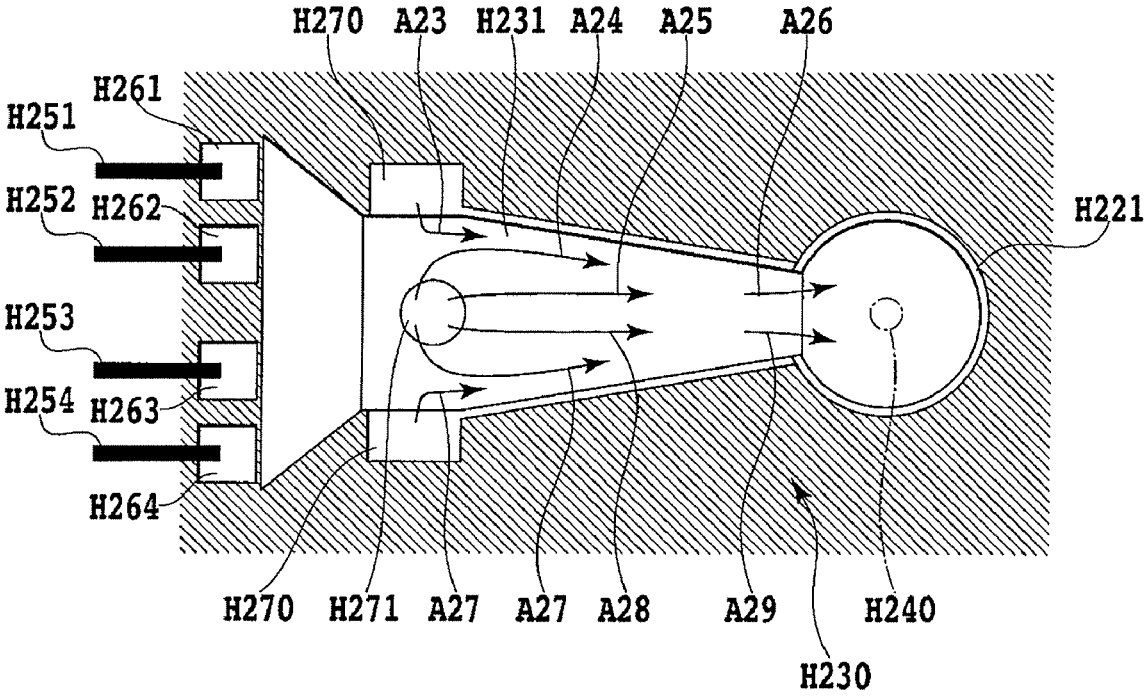
FIG. 5 is a view showing an ejection portion structure using a thermo-mechanical actuator according to a fourth embodiment of the present invention.

FIG. 5 is a view showing an ejection portion structure according to a fourth embodiment of the present invention and is similar to FIG. 1. The ejection portion of the present embodiment has a structure which is obtained by combining respective structures described above in Embodiment 1 and Embodiment 2.

More specifically, the separate liquid chamber has a cross sectional shape in which a small gap between the chamber and the outside of the cantilever element H230 exists except in the neighborhood of the fixed part of the cantilever element H230. Then, the groove for the separate liquid chamber opening H270 is provided on both sides of the cantilever element H230 in the neighborhood of the fixed part. Thereby, the first separate liquid chamber has a wide gap between the chamber and the cantilever element H230. Moreover, the circular opening H271 is provided on the part of the cantilever element H230 which is a fixed side to the inner wall of the first separate liquid chamber H223, and is the root of the cantilever element H230.

With the above structure, the flow resistance in the small gap between the separate liquid chamber and the cantilever element is adequately large when compared to the flow resistance for the separate liquid chamber openings H270 and the opening H271.

According to the above structure, ink flows from the common liquid chamber (not shown) to the separate liquid chamber are caused by ink ejection through enlarged gap H270 of the separate liquid chamber openings and the circular opening H271. That is, the flow occurs in the directions shown with arrows A23, A24, A25, A26, A27 A28 and A29 in FIG. 5. As a result of this, since stagnation in the first separate liquid chamber H222 is reduced, when refilling the ink after ink ejection or inflow due to the recovery operation, the ink in the first separate liquid chamber H220 can move overall. Therefore, the bubbles generated in the separate liquid chamber can be smoothly discharged without remaining there and accumulating so as to influence the ink ejection.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-179899, filed Jun. 29, 2006, which is hereby incorporated by reference herein in its entirety.

What is claimed is:

1. A printing head for ejecting ink comprising:

a cantilever element having a free end and a fixed end, said cantilever element making a bending action to generate pressure for ejecting the ink; and a liquid chamber in which said cantilever element is provided so that said cantilever element makes the bending action and which is divided into an upper chamber and a lower chamber having an ejection opening by a plane including a plane of said cantilever element, the plane of said cantilever element extending in directions perpendicular to a direction of ink ejected by the bending action, wherein a communicating opening for communicating the upper chamber with the lower chamber is provided in a neighborhood of the fixed end of said cantilever element, and in a part other than the communicating opening, the upper chamber communicates with the lower chamber through a gap the flow resistance of which is greater than that of the communicating opening.

2. A printing head as claimed in claim 1, wherein the communicating opening is formed between an inner wall of said liquid chamber which is located in the neighborhood of the fixed end of said cantilever element and a contour of said cantilever element.

3. A printing head as claimed in claim 1, wherein the communicating opening is an opening passing through said cantilever element, and is provided in the neighborhood of the fixed end of said cantilever element.

4. A printing head as claimed in claim 3, wherein the communicating opening has a circular shape.

5. A printing head as claimed in claim 3, wherein the communicating opening has a triangular shape.

6. A printing head as claimed in claim 1, wherein the communicating opening is formed between an inner wall of said liquid chamber which is located in the neighborhood of the fixed end of said cantilever element and a contour of said cantilever element, and the communicating opening is formed as an opening passing through said cantilever element, and is provided in the neighborhood of the fixed end of said cantilever element.

7. A printing head for ejecting ink comprising:

a cantilever element having a free end and a fixed end, said cantilever element making a bending action to generate pressure for ejecting the ink;

a liquid chamber in which said cantilever element is provided so that said cantilever element makes the bending action and which is divided into a first chamber and a second chamber having an ejection opening by a plane including a plane of said cantilever element, the plane of said cantilever element extending in directions perpendicular to a direction of ink ejected by the bending action; and a communicating portion for communicating the first chamber with the second chamber, wherein a communicating opening for communicating the upper chamber with the lower chamber is provided in a neighborhood of the fixed end of said cantilever element, and the flow resistance of the communicating opening is the smallest in the communicating portion.

* * * * *